United States Patent [19]

Gelin

[11] Patent Number: 5,044,978

[45] Date of Patent: Sep. 3, 1991

[54] CABLE CONNECTOR BLOCK, IN PARTICULAR FOR A SCREENED PAIR

[75] Inventor: Claude Gelin, Creteil, France

[73] Assignee: Cegelec, Levallois Perret, France

[21] Appl. No.: 530,055

[22] Filed: May 29, 1990

[30] Foreign Application Priority Data

May 31, 1989 [FR] France ..... 89 07182

[51] Int. Cl.[5] ..... H01R 4/24

[52] U.S. Cl. ..... 439/394; 439/579

[58] Field of Search ..... 439/579, 582, 578, 394, 439/395, 402, 403, 607, 609, 610

[56] References Cited

U.S. PATENT DOCUMENTS

| | | | |
|---|---|---|---|
| 4,533,191 | 8/1985 | Blackwood | 439/404 |
| 4,533,197 | 8/1985 | Prince et al. | 439/404 |
| 4,533,201 | 8/1985 | Wasserlein, Jr. | 439/404 |
| 4,744,774 | 5/1988 | Pauza | 439/394 |

FOREIGN PATENT DOCUMENTS

| | | | |
|---|---|---|---|
| 0251396 | 1/1988 | European Pat. Off. | 439/394 |
| 2509126 | 9/1975 | Fed. Rep. of Germany | 439/582 |
| 2936616 | 3/1981 | Fed. Rep. of Germany | 439/394 |

*Primary Examiner*—David L. Pirlot

*Attorney, Agent, or Firm*—Sughrue, Mion, Zinn, Macpeak & Seas

[57] ABSTRACT

A connector block enables an electrical device to be put into series with a cable having two wires, a drain and a metal sheath covered with an insulating covering. The insulating covering and the metal sheath are removed from a length L of the cable, and the drain and the wires are put into place longitudinally on a support provided with insulating piercing contact pieces for fixing and connecting the wires to a take-off cable. A cutting device slides in a housing in the support and cuts each wire between two contact pieces.

8 Claims, 4 Drawing Sheets

CABLE CONNECTOR BLOCK, IN PARTICULAR FOR A SCREENED PAIR

The invention relates to connecting an electrical device to a cable conveying a flow of information, the connection consisting in putting the device in series with the cable which constitutes an information bus.

BACKGROUND OF THE INVENTION

In a connection interconnecting a plurality of devices in a series, the need often arises to add in an extra device in series, and this is generally done by breaking the cable at the desired location and by connecting the device to said cable. This way of proceeding necessarily puts all of the devices out of operation while the connection is being performed.

Such series links are commonly used in local networks for bus transmission, the bus generally being a cable constituted a pair which is screened to provide protection against external electrical interference.

The object of the invention is to connect a device to a bus so as to put the device in series with the said bus at any position along the bus without causing a major disturbance to the flow of information along the bus, i.e. without putting the link out of service.

SUMMARY OF THE INVENTION

The present invention provides a connector block for a cable, in particular a screened pair cable including a drain and first and second insulated wires inside a metal sheath and an outer insulating covering, wherein:

the block comprises a support and a cutting device;

said support includes a housing for the cutting device, and first and second sets of insulation-piercing contact pieces, with the contact pieces in each set being disposed on either side of the housing;

the said insulating covering and metal sheath are removed from the location where the connector block is to be disposed, the first wire of the cable is inserted in the contact pieces of the first set and the second wire of the cable is inserted in the contact pieces of the second set;

a similarly screened take-off cable connected to an electrical device includes four wires each connected to one of the contact pieces in the first and second sets of contact pieces; and the cutting device is pushed into the housing in order to cut the first and second wires of the cable and to put the said electrical device into series with the said cable.

BRIEF DESCRIPTION OF THE DRAWINGS

An embodiment of the invention is described by way of example with reference to the accompanying drawings, in which.

DETAILED DESCRIPTION

Figure 1:
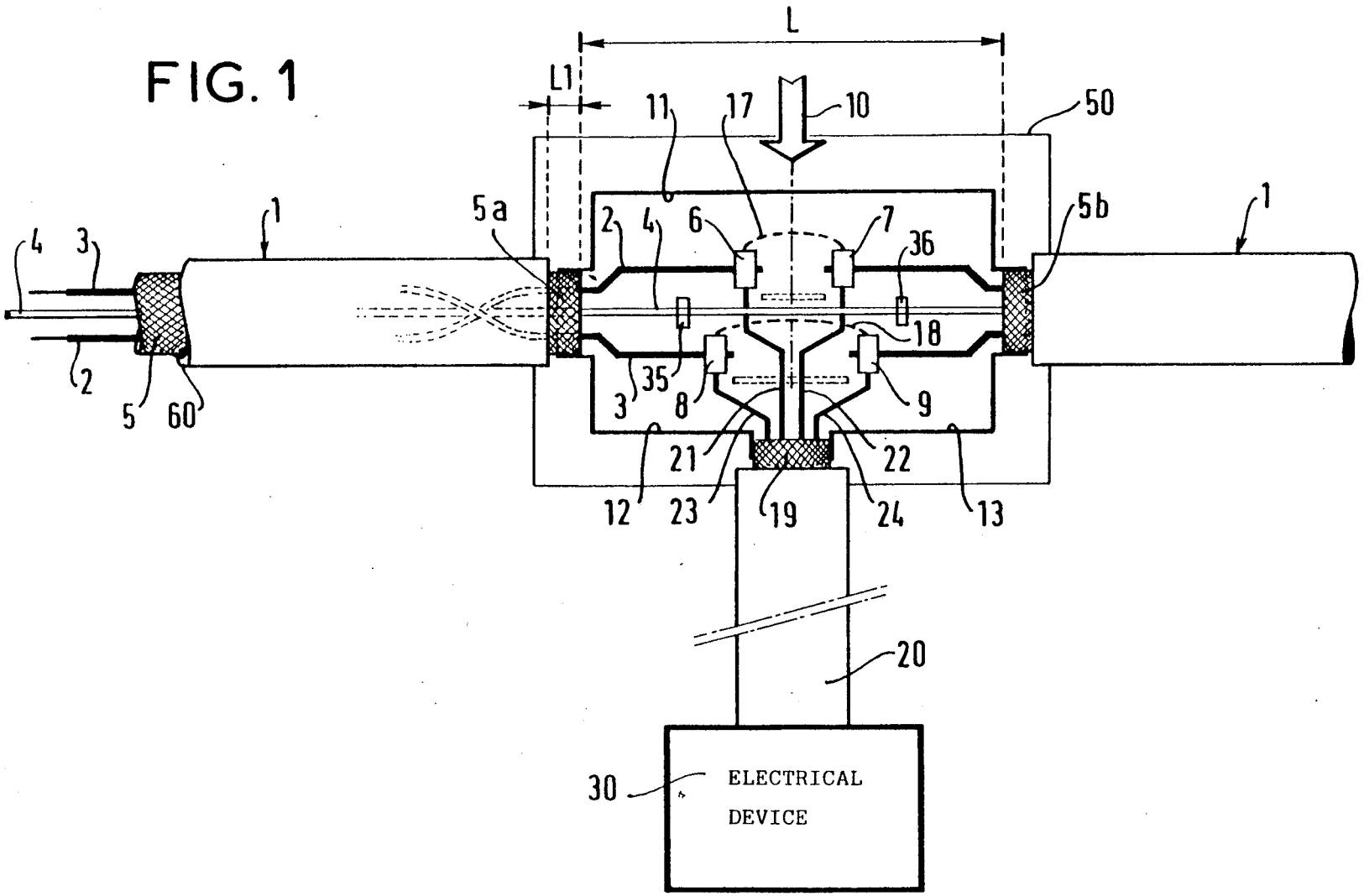
FIG. 1 is a theoretical diagram of a connector block of the invention.

FIG. 1 is a theoretical diagram of a connector block of the invention. The cable 1 is a screened pair cable having an earthing drain wire 4, with 2 and 3 designating the wires of the pair, 4 the drain wire, and 5 a metal screening sheath covered with an insulating covering 60. A cut-out of length L is formed at the position where connection is to take place, with the outer insulating covering 60 of the cable and its metal sheath 5 being removed and with a short length L1 of covering 60 being removed on either side of the cut-out so as to uncover metal sheath 5.

The cut-out gives access to the two wires 2 and 3 and to the drain 4 which is in metallic and electrical contact with the inside of the metal sheath 5. Inside a support 50, the wire 2 is connected to contact pieces 6 and 7, while the wire 3 is connected to contact pieces 8 and 9. A screened take-off cable 20 having four wires 21, 22, 23, and 24 connects an electrical device 30 to the connector block. The wires 21 to 24 are connected to respective ones of the contact pieces 6 and 9. The contact pieces 6 and 9 are of the insulation-piercing type, such that the wires 2 and 3 of the cable 1 are not cut. The device 30 is put into series with the wires 2 and 3 by cutting the wires 2 and 3 between contact pieces 6 and 7 or 8 and 9 as the case may be. This cutting is performed by means of a cutting device 10 which slides in a housing at the moment the device 30 is put into service.

Continuity of the screening of the cable 1 is provided by screening 11 interconnecting the ends 5*a* and 5*b* of the metal sheath 5 on either side of the cut-out. Similarly, the ends 5*a* and 5*b* are interconnected by screening 12 and 13 to the metal sheath 19 of the cable 20 which is situated on a side exit of the support.

To ensure earthing continuity, the drain wire 4 is connected to the screening 11 by contacts 35 and 36 placed on either side of the cutting device 10, which device has no effect on said continuity link.

Once the wires 2 and 3 have been cut with the device 30 then being connected in series, it is possible to re-establish continuity of said wires 2 and 3 by means of short-circuit straps 17 and 18 interconnecting contact pieces 6 and 7 or 8 and 9 as the case may be. When the straps are in place the device 30 can be removed or replaced.

Figure 2:
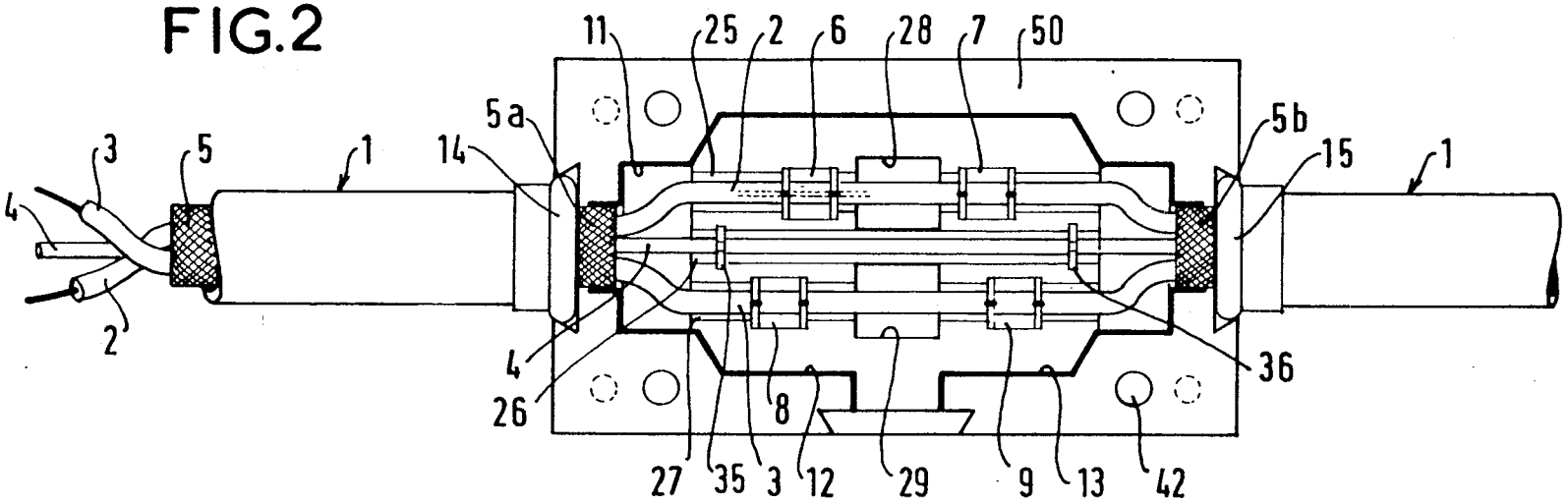
FIG. 2 is a diagrammatic plan view of a connector block of the invention.
Figure 3:
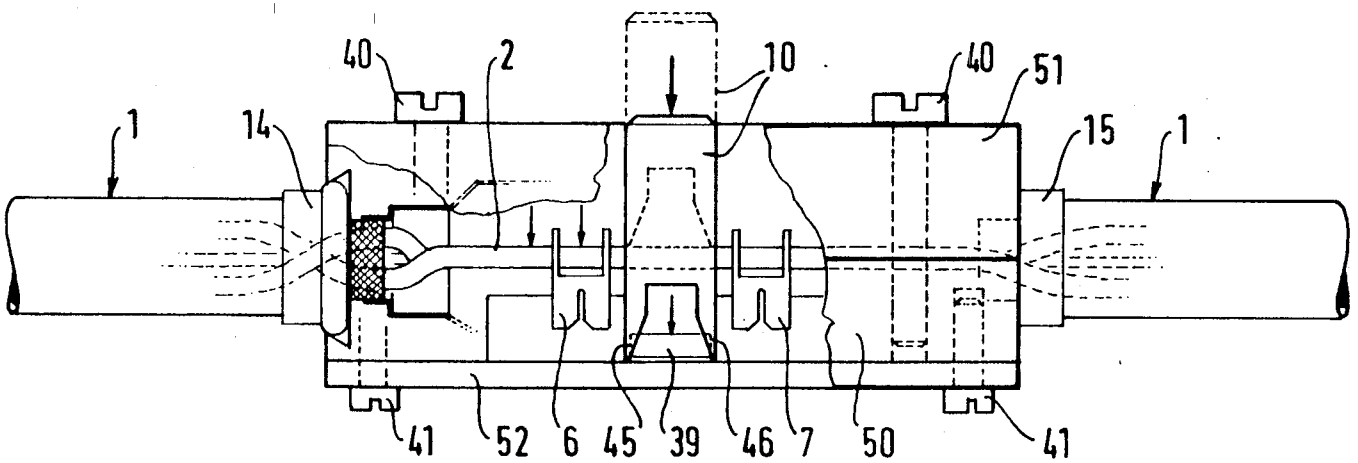
FIG. 3 is a partially cut-away elevation view of a connector block.

FIG. 2 is a diagrammatic plan view and FIG. 3 is a partially cut-away diagrammatic elevation view of a connector block of the invention. In these figures, the same reference numerals have the same meanings as in FIG. 1.

Two sets of gland packing 14 and 15 hold the cable 1 relative to the support 50 and seal the connections between the cable and the support. The wires 2 and 3 are disposed in grooves 25 and 27 in the support with the drain 4 being disposed in a groove 26 in which it is held by the contact pieces 35 and 36. The support 5 includes a housing constituted by two compartments 28 and 29 in which respective branches of the cutting device 10 slides. The compartment 28 is situated between contact pieces 6 and 7 while the compartment 29 is situated between contact pieces 8 and 9. These compartments are situated on opposite sides of the groove 26, and are thus separated from the said groove 26 in which the drain 4 is disposed.

The connection block also includes an insulating lid 51 and an insulating bottom plate 52 whose portions facing the support are metal coated. The lid 51 and the support 50 are fixed together by means of screws 40 which engage in holes 42 in the support, with the bottom plate being fixed to the support 50 by screws 41.

Figure 5:
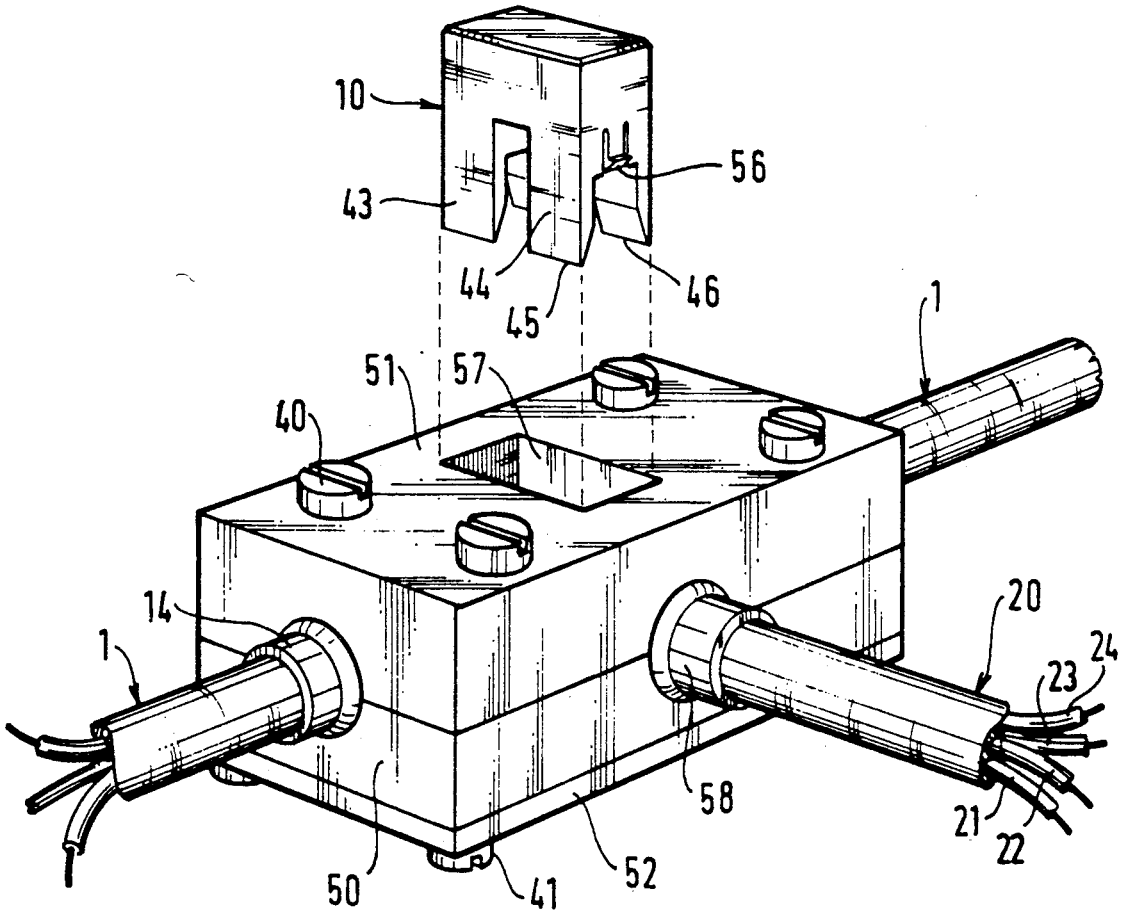
FIG. 5 is a perspective view of a connector block.

The cutting device 10 which is shown in perspective in FIG. 5, is made of insulating material. It has two branches 43 and 44 each of which slides in a corresponding one of the compartments and each of which is terminated by a U-shape portion whose ends 45 and 46 constitute two knives that slide along the walls of the compartments that extend perpendicularly to the wires to be cut.

When pushed home in a compartment, these two knives cut off a portion 39 of wire extending between the two opposite walls of the compartment.

In FIG. 3, the cutting device is shown in its down position, while its up position is shown by dashed lines.

Figure 4:
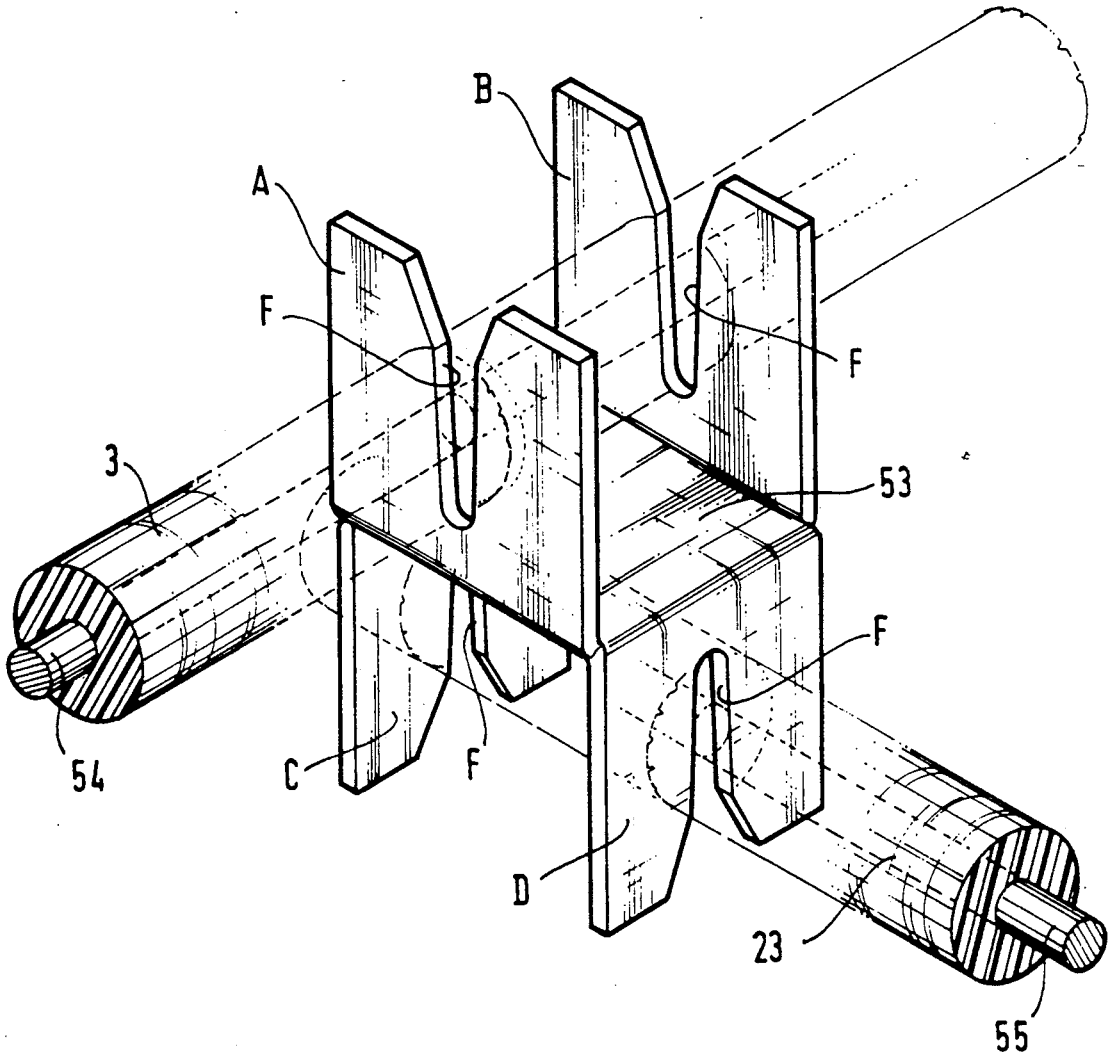
FIG. 4 shows a contact piece used in the connector block.

The contact pieces 6, 7, 8, and 9 may be constituted, for example, by pairs of contact pieces as shown in FIG. 4. The contact pieces 35 and 36 for the drain wires are contact pieces of the type having two opposite forks in conventional manner or else they are paired contact pieces like the contact pieces 6, 7, 8, and 9 in order to be electrically connected with the internal metallization of the support, of the bottom plate, and of the lid, thereby ensuring earthing continuity for the cable 1. The contact piece is in the form of two U-shape portions sharing a common base 53.

A first U-shape portion comprises branches A and B, while the second U-shape portion comprises branches C and D. The branches A and B project to one side of the base 53 and the branches C and D are situated on the other side of the said base, with the branches A and B being at 90° to the branches C and D. Each branch includes an insulation-piercing slit F in conventional manner. A contact piece serves to interconnect two insulated wires 3 and 23. The wire 3 is inserted in the branches A and B so that its conductor 54 makes contact with the edges of the slit F in these branches. The wire 23 is inserted in the branches C and D so that its conductor 55 makes contact with the edges of the slit F in these branches. The wires 3 and 23 are perpendicular to each other. The contact pieces 6, 7, 8, and 9 are all constituted by pairs of contact pieces as shown in FIG. 4 and they therefore serve to interconnect the cables 1 and 20 (FIG. 1) which cables are perpendicular to each other.

FIG. 5 is a diagrammatic perspective view of a connector block showing the cutting device 10 prior to being inserted in the block, with the lid 51 including an opening 57 for this purpose. The cutting device 10 includes two catches such as 56, one per branch 43, 44 of the cutting device. These catches are situated on opposite sides of the cutting device and they engage with the lid 52 when in the down position in order to hold the cutting device in said down position. The outlet from the block for the cable 20 takes place sideways with an insulating sleeve 58 holding and sealing the end of the cable 20.

A connector block of the invention is installed as follows:

a cut-out is formed in the cable 1, at the desired location;

the wires 2 and 3 and the drain wire 4 are placed in the grooves 25, 26, and 27 of the support 50 over the contact pieces 6, 7, 8, 9, 35, and 36;

the sets of gland packing 14 and 15 are put into place and the lid 51 is screwed onto the support 50, and while the screws are being tightened, the lid bears down on the wires 2 and 3 and on the drain wire 4, thereby inserting them in the slits F of the contact pieces; and the cutting device 10 is inserted in the opening 57 of the lid 51 and is left in the high position, i.e. in a position where the wires 2 and 3 are not cut.

The connection with the device 30 takes place with the bottom plate removed. The wires 21, 22, 23 and 24 of the take-off cable 20 (FIG. 1) are inserted in the bottom branches of the contact pieces 6, 7, 8, and 9, and then the bottom plate is screwed onto the support, such that while the screws of the bottom plate are being tightened, the wires 21 to 24 are inserted into the slits of the bottom branches of the contact pieces.

The cutting device 10 is then put home so that it occupies its down position. The wires 2 and 3 are cut and the device 30 is connected in series with the wires 2 and 3 of the cable 1.

It is also possible to begin by mounting the take-off cable 20 to the connector block and then fix the block to the cable 1 in the manner described above, with the device 20 being brought into service, i.e. connected in series with the cable, by pushing home the cutting device 10 after the lid 51 has been fixed to the support 50. The metal coatings of the support, the lid, and the bottom plate coming into contact with the metal sheaths of the cable 1 and of the take-off cable 20 ensure that the connector block has electromagnetic protection.

The up or down position of the cutting device 10 provides a visual indication as to whether the branch connection is operational (i.e. device 10 pushed home and locked in its down position) or not operational (i.e. the device 10 projecting and locked in its up position).

I claim:

1. A connector block for a screened pair cable including a drain wire and first and second insulated wires inside a metal sheath and an outer insulating cover, said block comprising:

a support and a slidable cutting device;

said support including a housing slidably mounting the cutting device for movement between a first extracted end position and a second projected end position, and first and second sets of insulation-piercing contact pieces, with the contact pieces in each set being disposed on opposite sides of the housing with the first and second insulated wires crossing the housing between the two end positions of the slidable cutting device;

a length of said insulating covering and metal sheath being removed at the location of the connector block, said first wire of the cable being inserted in the contact pieces of the first set and the second wire of the cable being inserted in the contact pieces of the second set;

a similarly screened take-off cable being connected to an electrical device and including four wires, each of said four wires being connected to a respective one of the contact pieces in the first and second sets of contact pieces; and said slidable cutting device being pushed into the housing to said second projected end position and said knives cutting the first and second wires of the cable thereby putting said electrical device into series with said cable.

2. A block according to claim 1, wherein the contact pieces of the first and second sets of contact pieces are connected by straps which re-establish continuity of the wires of the cable prior to the series device being disconnected.

3. A connector block according to claim 1, wherein:

the support includes first, second, and third longitudinal grooves;

the contact pieces being disposed in the first and second groves;

the first and second wires being disposed in the first and second grooves over the contact pieces and the drain wire being disposed in the third groove;

a lid fixed on the support pressing the first and second wires in the contact pieces;

the third groove is situated between the first and second grooves;

the housing is constituted by first and second laterally spaced compartments separated by the third groove, the first groove being interrupted by the first compartment and the second groove being interrupted by the second compartment;

said cutting device includes first and second branches received in the first and second compartments respectively, passing through an opening in the lid with each branch being U-shaped and having ends defining knives which are perpendicular to the grooves;

whereby slidable depression of the cutting device applies pressure to the cutting device; and wherein the cutting device slidably projected to the second end position applies pressure to the cutting device effecting severance of a length of the first wire by the knives of said first branch and severance of a length of a second wire by the knives of the second branch.

4. A block according to claim 3, wherein each contact piece includes at least one top branch disposed in a groove and at least one bottom branch accessible from a bottom face of the support.

5. A connector block according to claim 3, wherein said block further includes a bottom plate fixed to the support on a side thereof opposite to the lid, and wherein each of the support, the lid, and the bottom plate include metal coatings with all of the metal coatings being electrically connected to the metal sheath of the cable and to screening of the take-off cable to effect earthing continuity and electromagnetic protection for the block.

6. A block according to claim 5, further comprising the two contact pieces in the third groove connected to said metal coatings of said support, said cover, and said bottom plate.

7. A block according to claim 3, wherein the third groove includes two contact pieces into which the drain wire is inserted by said lid.

8. A block according to claim 7, wherein each contact piece includes at least one top branch disposed in a groove and at least one bottom branch accessible from a bottom face of the support.

* * * * *